United States Patent [19]

Fernandez

[11] 4,453,849

[45] Jun. 12, 1984

[54] PROTECTIVE SHIELD FOR A FELT TIP PEN

[76] Inventor: Manuel J. Fernandez, 7009 Maynard Ave., Canoga Park, Calif. 91307

[21] Appl. No.: 389,906

[22] Filed: Jun. 18, 1982

[51] Int. Cl.[3] ..... B43K 23/00; B43K 8/02; B43K 3/02; B43L 13/02

[52] U.S. Cl. ..... 401/193; 33/41 F; 401/14; 401/196; 401/198

[58] Field of Search ..... 401/196, 198, 199, 193, 401/14, 15, 48; 33/39 B, 41 F

[56] References Cited

U.S. PATENT DOCUMENTS

| | | | |
|---|---|---|---|
| 12,182 | 1/1855 | Hicks . | |
| 595,389 | 12/1897 | Harmon | 33/41 F |
| 697,548 | 4/1902 | Schwab | 401/198 |
| 2,396,058 | 3/1946 | Rath . | |
| 2,496,086 | 1/1950 | Fitzgerald . | |
| 2,684,052 | 7/1954 | Rickmeyer . | |
| 2,697,416 | 12/1954 | Simmons . | |
| 3,044,101 | 7/1962 | Rosenthal . | |
| 3,245,146 | 4/1966 | Rogers | 401/193 X |
| 3,448,722 | 6/1969 | Krizman . | |
| 3,464,775 | 9/1969 | Beal | 401/199 |
| 3,510,934 | 5/1970 | Koelichen | 401/198 X |
| 3,639,070 | 2/1972 | Davidson . | |
| 3,814,526 | 6/1974 | Lotfallah | 401/199 |
| 3,887,287 | 6/1975 | Rosh, Jr. | 401/198 X |
| 4,308,664 | 1/1982 | Morris | 33/41 F |

FOREIGN PATENT DOCUMENTS

| | | | |
|---|---|---|---|
| 2350971 | 1/1975 | France | 401/198 |
| 347097 | 7/1960 | Switzerland | 401/193 |

*Primary Examiner*—Steven A. Bratlie

*Attorney, Agent, or Firm*—Fulwider, Patton, Rieber, Lee & Utecht

[57] ABSTRACT

A protective shield for a felt tip pen is provided for spacing the ink-laden felt nib of the pen from a ruling edge to prevent ink from contacting or bleeding under the ruling edge. The protective shield includes a relatively thin plate substantially overlying one side of the felt nib and including a relatively short wing projecting at least slightly beyond one longitudinal margin of the overlaid side. In use, the plate engages the ruling edge with its outboard face to space the felt nib therefrom when the felt nib is moved over a writing surface in a direction generally parallel with the plate. Alternatively, when the felt nib is moved over a writing surface in a direction generally perpendicular to the plate, the free marginal edge of the wing engages the ruling edge to maintain the nib in spaced relation therewith. In some embodiments, the protective shield is adapted for relatively easy installation and/or removal with respect to the felt nib, whereas in another embodiment the shield is applied directly to the nib as a coating.

5 Claims, 10 Drawing Figures

PROTECTIVE SHIELD FOR A FELT TIP PEN

BACKGROUND OF THE INVENTION

This invention relates generally to a protective device for use with a so-called felt tip pen to prevent ink from contacting or bleeding under a ruling edge, such as the straight edge of a ruler or the like.

Felt tip pens in general are known in the art and typically comprise an elongated pen body or barrel which supports at one end an outwardly projecting nib. This nib is formed from a porous material, such as a compressed bundle of natural and/or synthetic fibers, commonly referred to as "felt", to have a generally rectangular cross section terminating at its end opposite the barrel in a rectangular-shaped writing tip to which ink is transferred from within the barrel by capillary action. This writing tip is typically cut at an oblique angle to permit full-surface engagement thereof with a selected writing surface, such as paper, poster board, or the like, while the pen is held at a comfortable and normal writing angle. As is well known, felt tip pens can be used to draw a relatively broad or comparatively narrow line depending upon the direction in which the writing tip is moved over the writing surface.

Felt tip pens of the type described are available in a variety of different colors, and as a result, these pens are used by many artists in the production of a wide variety of artistic works. However, significant problems are encountered with such pens when the nib thereof is guided over the writing surface by a ruling edge, such as the edge of a ruler, French curve, or the like, to form a line having a particular shape. Specifically, the ink-soaked nib directly contacts the ruling edge to leave an ink residue thereon which, if the ruling edge is not wiped clean after each use, can be picked up and transferred to the writing surface by a subsequently used pen. This is particularly undesirable when the subsequently used pen carries ink of a different color, since the transferred residue tends to discolor the line being drawn.

In addition, when the felt nib is guided over a writing surface by a ruling edge, the ink carried by the nib sometimes bleeds beneath the ruling edge. This results in a drawn line with an unintended fuzzy or smudged boundary which is highly unattractive in appearance.

There exists, therefore, a significant need for a device which can be used with a felt tip pen to prevent the felt nib of the pen from contacting a ruling edge during use. The present invention fulfills this need.

SUMMARY OF THE INVENTION

In accordance with the invention, a protective shield for a felt tip pen is provided for spacing the ink-soaked felt nib of the pen from the ruling edge of a ruler, French curve, or the like, when the nib is guided over a writing surface by the ruling edge. The shield thereby prevents ink from being transferred to the ruling edge such that the ruling edge remains clean for subsequent uses without fear of transferring undesired colors to the writing surface and without requiring the ruling edge to be wiped clean. The protective shield further prevents ink from the felt nib from bleeding beneath the ruling edge thereby making possible the formation of ruled lines having precise boundaries.

In one preferred form, the protective shield comprises a relatively thin and generally planar plate sized and shaped to overlie substantially one side of a felt nib having a generally rectangular cross section. The plate thus provides a relatively thin spacing element positioned between the overlaid side and a ruling edge for preventing contact between the nib and the ruling edge as the nib is guided along the ruling edge over a writing surface in a direction generally parallel with the plate. In addition, the plate includes a relatively short wing which projects at least slightly beyond one longitudinal margin of the overlaid side for engaging the ruling edge to space the nib therefrom when the nib is guided along the ruling edge in a direction generally perpendicular to the plate.

According to one embodiment of the invention, the plate is joined generally in a common plane to an elongated blade sized and shaped for removable reception into the pen barrel to position the plate in substantially overlying relation with one side of the nib. With this construction, the protective shield can be positioned to overlie either one of the opposite sides of the nib as desired typically in accordance with whether the user is right- or left-handed, or a pair of the shields can be provided to overlie both of the opposite sides of the nib. A relatively small hole is formed in the plate for reception of a pointed tool to facilitate installation and/or removal of the shield with respect to the felt nib.

In one alternative form, the protective shield includes a pair of plates sized to substantially overlie opposite sides of the felt nib, wherein the wings of the two plates are joined to each other by a connecting leg such that the protective shield has a generally U-shaped cross section for wrapping about three sides of the nib. The connecting leg has a length preferably slightly less than the width of the nib whereby the plates are pressed relatively snugly against the opposite sides of the nib with sufficient force to retain the shield in place. Conveniently, one or both of the interconnected plates has a relatively small hole therein for reception of a sharp tool to facilitate shield installation and/or removal, and both plates desirably include outwardly flared tabs disposed opposite the connecting leg to permit relatively easy sliding of the shield onto the felt nib.

In a further alternative form of the invention, the protective shield can be provided as a relatively thin coating of plastic material or the like which substantially encases the sides of the felt nib leaving exposed the writing tip for engagement with a writing surface.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
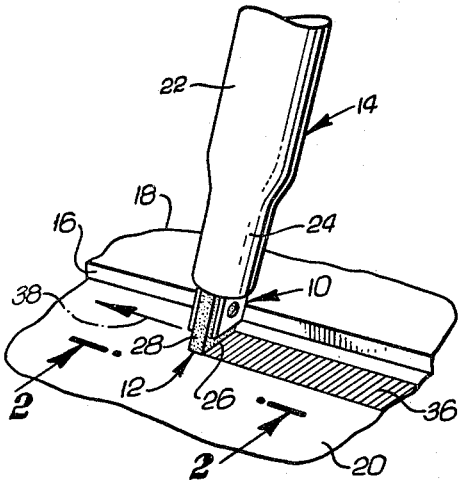
FIG. 1 is a fragmented perspective view of a felt tip pen including a pair of protective shields embodying the novel features of the invention, and illustrating guided movement of the pen along a straight edge for making a relatively broad line on a writing surface.
Figure 2:
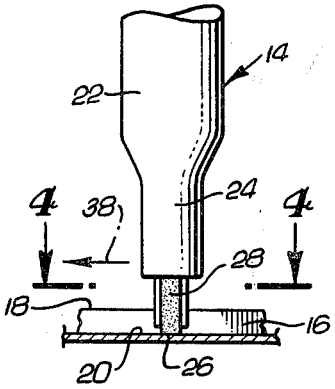
FIG. 2 is a fragmented front elevation view of the felt tip pen taken generally on the line 2—2 of FIG. 1.
Figure 3:
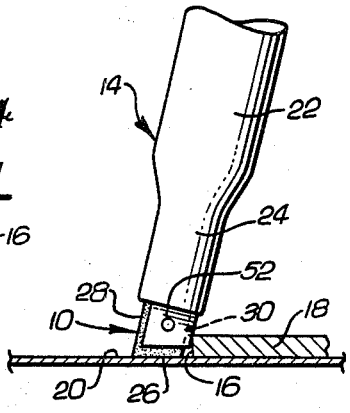
FIG. 3 is a fragmented side elevation view of the felt tip pen illustrated in FIG. 1.
Figure 4:
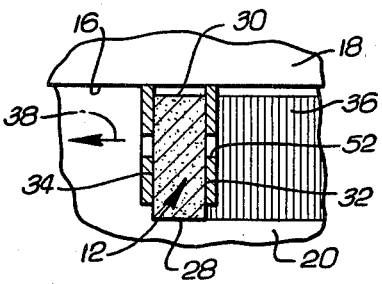
FIG. 4 is an enlarged fragmented horizontal section taken generally on the line 4—4 of FIG. 2.
Figure 5:
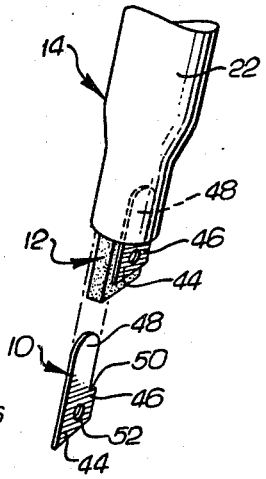
FIG. 5 is a fragmented and partially exploded perspective view of the felt tip pen of FIG. 1, and illustrating removal and/or installation of one of the protective shields.

As shown in the exemplary drawings, a protective shield referred to generally by the reference numeral 10 is provided for spacing the nib 12 of a felt tip pen 14 from a ruling edge 16 of a ruler 18 or the like when the nib 12 is guided along the ruling edge in contact with a writing surface 20. The protective shield 10 thus functions to prevent ink transfer from the nib 12 to the ruling edge 16 and to prevent ink from bleeding under the ruling edge.

The protective shield 10 of this invention is designed primarily for use with a conventional felt tip pen 14 of the type including a nib 12 projecting outwardly from one end of a pen body or barrel 22, as illustrated in FIGS. 1–5. The nib 12 is formed from a porous material, such as a compressed bundle of natural and/or synthetic so-called "felt" fibers, typically to have a generally rectangular cross section defining a relatively short front and rear faces 28 and 30 and comparatively longer lateral sides 32 and 34. Accordingly, the nib 12 has a relatively narrow transverse width and a comparatively longer length in the fore-aft direction.

The nib 12 is seated snugly within a relatively narrow throat portion 24 at the end of the pen barrel 22 with at least part of the nib projecting longitudinally from the barrel for engaging the writing surface 20, such as paper, poster board, or any other suitable material. Ink contained within the barrel 22 is transferred through the nib by capillary action to the generally rectangular free end or writing tip 26 of the nib for further transfer of the ink to the writing surface 20. Conveniently, as shown best in FIGS. 1 and 3, this writing tip 26 of the nib extends at an oblique angle from the nib front face 28 to the rear face 30 such that the writing tip 26 is oriented for full-surface engagement with the writing surface 20 when the pen 14 is held at a normal and comfortable writing angle.

The felt tip pen 14 can be used to make a relatively broad or a relatively narrow width line on the writing surface 20, depending upon the direction in which the nib 12 is moved over the writing surface relative to the nib length and width. More specifically, as viewed in FIGS. 1 and 4, the nib 12 makes a relatively broad line 36 on the writing surface when the nib is moved in a direction parallel with the front and rear faces 28 and 30, as depicted by arrow 38. However, as viewed in FIG. 6, the nib makes a relatively narrow line 40 on the writing surface when moved thereover in a direction parallel with the lateral sides 32 and 34, as depicted by arrow 42. The particular shape and direction of the drawn line 36 or 40 can be closely controlled by use of the ruling edge 16 to guide movement of the nib over the writing surface, wherein this ruling edge can be linear, as illustrated, or have any other desired shape, such as, for example, the curved ruling edge of a so-called French curve template.

In accordance with the invention, the protective shield 10 provides a relatively simple and inexpensive device for spacing the nib 12 of a felt tip pen from the ruling edge 16 irrespective of the nib orientation to draw a broad line 36 or a narrow line 40. The protective shield 10 thus prevents transfer of ink from the nib to the ruling edge thereby avoiding any necessity to clean the ruling edge after each use lest accumulated ink residue be picked up by the nib of a subsequently used pen and undesirably transferred to the writing surface. Moreover, the protective shield prevents contact between the ruling edge and the drawn line 36 or 40 whereby the ink cannot bleed beneath the ruling edge to create smudges or smears before the ink dries.

The protective shield 10 is illustrated in one preferred form in FIGS. 1–6. As illustrated, the protective shield 10 comprises at least one relatively thin plate 44 of plastic or the like shaped to substantially overlie the exposed portion of one of the lateral sides 32 or 34 of the nib 12 and having a thickness typically on the order of about 0.05 inch. More specifically, the plate 44 extends from the end of the pen barrel substantially covering the associated side 32 or 34 of the nib 12 and terminates preferably slightly short of the writing tip 26 in a distal end which is conveniently cut at an oblique angle generally in parallel with the writing tip. Importantly, a relatively short wing 46 projects from the plate 44 at least slightly beyond the longitudinal margin of the nib rear face 30 by a relatively short distance corresponding generally with the thickness of the plate.

Figure 6:
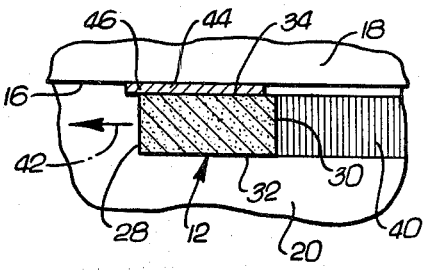
FIG. 6 is an enlarged fragmented horizontal section generally similar to FIG. 4 and illustrating guided movement of the pen along a straight edge for making a relatively narrow line on a writing surface.

The plate 44 of the protective shield is further joined to an anchoring blade 48 having a size and shape for insertion into the barrel throat 24 of the felt tip pen alongside one of the lateral sides 32 or 34 of the nib 12, as shown best in FIG. 6. Accordingly, the blade 48 can be seated snugly between the rib and the barrel throat 24 to secure the plate snugly in a position substantially overlying a selected one of the lateral sides 32 and 34. Conveniently, the outwardly projecting wing 46 joined to the associated plate 44 defines a relatively small shoulder 50 which engages the end of the barrel throat when the blade 48 is inserted thereinto to provide a stop member preventing overinsertion of the shield into the barrel throat.

In one preferred form, two of the protective shields 10, as described above, are installed respectively against the two lateral sides 32 and 34 of the nib 12 to substantially overlie both of said sides. These protective shields can be installed during manufacture of the felt tip pen 14, or alternatively, the shields can be provided as separate items which can be installed by the user. In this regard, the plate 44 of each shield 10 advantageously includes a relatively small hole 52 therein for reception of a relatively sharp tool (not shown) to facilitate removal of either or both shields by the user and/or to facilitate installation by the user of one or both shields when provided separately.

In use, the protective shields 10 prevent contact between the ink-soaked nib 12 and the ruling edge 16 irrespective of the orientation of the nib relative to the ruling edge. That is, as viewed in FIGS. 1, 3, and 4, movement of the nib along the ruling edge in a direction generally perpendicular with the plate portions 44 of the shields 10 to draw a broad line 36 results in contact of the ruling edge by the marginal edges of the wings 46 to maintain the nib in slight spaced relation to the ruling edge. Importantly, while this spaced relation is illustrated by use of two of the shields 10, it is to be understood that the desired spacing can be maintained by use of a single shield 10 overlying a selected one of the nib lateral sides 32 or 34.

In addition, the nib 12 is maintained in spaced relation with the ruling edge 16 during movement of the nib generally parallel with the plate 44 to draw the narrow line 40, as viewed in FIG. 6. More specifically, the plate 44 of the shield is disposed to engage the ruling edge with its outboard face to maintain the desired spaced relation. Importantly, while FIG. 6 illustrates this operational feature by use of a single protective shield 10, it is to be understood that two of the shields installed as illustrated in FIGS. 1–5 can be used wherein the specific shield in engagement with the ruling edge will depend upon the relative direction in which the nib is guided along the ruling edge. As a practical matter, however, a single protective shield is sufficient for most users, since a right-handed individual will tend to move the nib in the same direction relative to the ruling edge, whereas a left-handed individual will tend to move the nib in an opposite direction.

The protective shield 10 of this invention thus provides a simple yet highly effective device for preventing an ink-soaked felt nib from contacting a ruling edge during use. The invention thus prevents ink residue from accumulating on the ruling edge wherein this residue would otherwise need to be wiped off after each use to prevent subsequent transfer to the writing surface. In addition, the ruling edge is spaced from the boundary of lines drawn by the nib such that the lines are allowed to dry with sharp border definition without smudging or smearing beneath the ruling edge.

Figure 7:
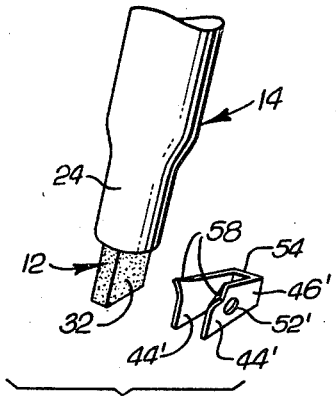
FIG. 7 is a fragmented perspective view of a felt tip pen in exploded relation with an alternative form of a protective shield embodying the novel features of the invention.
Figure 8:
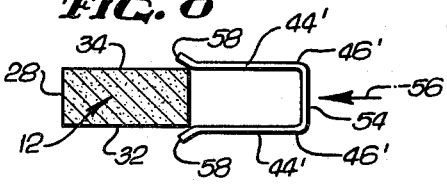
FIG. 8 is an enlarged horizontal section taken through the felt nib of the pen illustrated in FIG. 7 and further illustrating installation of the alternative protective shield onto the nib.

An alternative form of the protective shield of this invention is illustrated in FIGS. 7 and 8 for use with a felt tip pen 14 having a nib 12 as described with respect to FIGS. 1–6. In this alternative embodiment, however, the protective shield includes a pair of relatively thin plates 44' sized to substantially overlie the two lateral sides 32 and 34 of the felt nib 12, wherein these plates 44' include relatively short wings 46' joined together by a connecting leg 54. Accordingly, the shield has a generally U-shaped cross section for wrapping about and substantially overlying three sides of the nib 12, including the two lateral sides 32 and 34 and the rear face 30.

The connecting leg 54 is sized to have a length preferably slightly less than the transverse width of the nib. With this construction, when the shield is installed onto the nib by pushing in the direction of arrow 56 in FIG. 8, the connecting leg 54 holds the plates 44' tightly against the lateral sides 32 and 34 of the nib with sufficient force to prevent the shield from working loose during normal use. Conveniently, the corners of the plates 44' opposite the connecting leg 54 and adjacent the barrel throat 24 are flared out to form tabs 58 which facilitate sliding movement of the shield onto the nib, and at least one of the plates 44' includes a central hole 52' for reception of a sharp tool (not shown) for use in installing and/or removing the shield from the nib.

Figure 9:
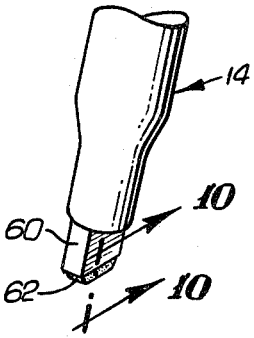
FIG. 9 is a fragmented perspective view of a felt tip pen in combination with a further alternative form of the protective shield of this invention.
Figure 10:
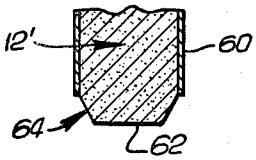
FIG. 10 is an enlarged fragmented vertical section taken generally on the line 10—10 of FIG. 9.

A further modified form of the invention is illustrated in FIGS. 9 and 10 wherein the protective shield is provided as a relatively thin coating or casing 60 of plastic or the like applied directly to the nib 12' of a felt tip pen 14. This casing 60 substantially covers the nib 12', with the exception of an exposed writing tip 62. Thus, the casing 60 is disposed for engaging a ruling edge to prevent contact between the ruling edge and the nib 12', regardless of the nib orientation during use. The desired spacing between the ruling edge and the nib can be advantageously enhanced by beveling the periphery of the writing tip 62, as illustrated in FIG. 10 by arrow 64.

A variety of modifications and improvements to the invention described herein are believed to be apparent to one skilled in the art. Accordingly, no limitation on the invention is intended by way of the description and embodiments described herein, except as set forth in the appended claims.

What is claimed is:

1. For use with a felt tip pen having a nib of generally rectangular cross section projecting longitudinally from one end of a pen barrel and terminating in a generally rectangular writing tip, a protective shield for preventing contact between the nib and a ruling edge when the nib is guided along the ruling edge in engagement with a writing surface, comprising:

a relatively thin and generally planar plate sized and shaped to overlie a selected longitudinal side of the nib;

a relatively thin and generally planar blade formed coplanar with said plate and projecting therefrom for relatively snug reception into the end of the pen barrel alongside the selected side of said nib for mounting said plate in overlying relation against the selected side of the nib with one edge of said plate terminating slightly short of the nib writing tip, said plate having an outboard face for contacting the ruling edge to space the nib from the ruling edge when the nib is guided along the ruling edge in a direction generally parallel with said plate and with said plate disposed between the nib and the ruling edge; and a relatively short wing generally coplanar with said plate and projecting outwardly from one side of said plate, said plate and said wing having a combined width greater than the width of said blade, and said wing defining a shoulder formed thereon for abutting engagement with the end of the pen barrel when said blade is received thereinto, said wing projecting from said plate at least slightly beyond one longitudinal margin of the selected side of the nib when said plate is mounted thereagainst, said wing having a free marginal edge for contacting the ruling edge to space the nib therefrom when the nib is guided along the ruling edge in a direction generally perpendicular to said plate with said wing disposed between the nib and the ruling edge.

2. The protective shield of claim 1 including a pair of said plates sized and shaped for overlying selected opposite sides of the nib, a pair of said blades respectively formed generally coplanar with said pair of plates, and a pair of said wings projecting respectively from said pair of plates.

3. The protective shield of claim 1 wherein said plate has a relatively small hole formed therein.

4. The protective shield of claim 1 wherein said wing is sized to project outwardly from said one side of said plate and beyond the one longitudinal margin of the nib by a distance approximating the thickness of said plate.

5. For use with a felt tip pen having a nib of generally rectangular cross section projecting longitudinally from one end of a pen barrel and terminating in a free end defining a writing tip, a protective shield for preventing contact between the nib and a ruling edge when the nib is guided along the ruling edge with the writing tip in engagement with a writing surface, comprising:

a pair of relatively thin and generally planar plates sized and shaped to substantially overlie respectively a selected opposite pair of sides of the nib, at least one of said plates having a relatively small hole formed therein;

a relatively thin and generally planar connecting leg connected between adjacent sides of said plates and disposed generally perpendicular to said plates to define an open-sided and generally U-shaped shield structure; and an outwardly flared corner tab on at least one of said plates at a position generally opposite said connecting leg and generally adjacent the open side of the shield structure, said tab facilitating reception of the nib into the open side of the shield structure to mount the shield structure on the nib with said plates overlying the selected opposite sides of the nib, said connecting leg having a length measured between said plates at least slightly less than the thickness of the nib between the selected opposite sides such that said plates are supported by said connecting leg in compressive bearing engagement respectively with the selected opposite sides of the nib;

one of said plates being interposed between the nib and the ruling edge to space the nib therefrom when the nib is guided along the ruling edge in a direction generally parallel with said plates, and said connecting leg having an outboard face for contacting the ruling edge to space the nib therefrom when the nib is guided along the ruling edge in a direction generally perpendicular to said plates with said connecting leg disposed between the nib and the ruling edge.

* * * * *